US007039198B2

(12) United States Patent
Birchfield et al.

(10) Patent No.: US 7,039,198 B2
(45) Date of Patent: May 2, 2006

(54) ACOUSTIC SOURCE LOCALIZATION SYSTEM AND METHOD

(75) Inventors: Stanley T. Birchfield, Santa Clara, CA (US); Daniel K. Gillmor, San Francisco, CA (US)

(73) Assignee: Quindi, Palo Alto, CA (US)

( * ) Notice: Subject to any disclaimer, the term of this patent is extended or adjusted under 35 U.S.C. 154(b) by 968 days.

(21) Appl. No.: 09/922,370

(22) Filed: Aug. 2, 2001

(65) Prior Publication Data

US 2002/0097885 A1 Jul. 25, 2002

Related U.S. Application Data

(60) Provisional application No. 60/247,138, filed on Nov. 10, 2000.

(51) Int. Cl.
*H04R 3/00* (2006.01)

(52) U.S. Cl. ..... 381/92; 348/14.08

(58) Field of Classification Search ..... 381/92; 348/14.01, 14.08; 379/202.01
See application file for complete search history.

(56) References Cited

U.S. PATENT DOCUMENTS

| | | | | |
|---|---|---|---|---|
| 4,536,887 | A | 8/1985 | Kaneda et al. | |
| 4,581,758 | A | 4/1986 | Coker et al. | |
| 5,465,302 | A | 11/1995 | Lazzari et al. | |
| 5,526,433 | A | 6/1996 | Zakarauskas et al. | |
| 5,737,431 | A | 4/1998 | Brandstein et al. | |
| 5,778,082 | A | 7/1998 | Chu et al. | |
| 5,959,667 | A | 9/1999 | Maeng | |
| 6,005,610 | A | 12/1999 | Pingali | |
| 6,600,824 | B1 | 7/2003 | Matsuo | |
| 6,774,934 | B1 * | 8/2004 | Belt et al. | 381/92 |
| 2003/0179890 | A1 * | 9/2003 | Matsuo | 381/92 |

OTHER PUBLICATIONS

C.H. Knapp and G.C. Carter, "The Generalized Correlation Method for Estimation of Time Delay", *IEEE Transactions on Acoustics, Speech, and Signal Processing*, vol. 24, No. 4, pp. 320–327, Aug. 1976.

M. Omologo and P. Svaizer, "Use of the Crosspower–Spectrum Phase in Acoustic Event Location", *IEEE Transactions on Speech and Audio Processing*, vol. 5, No. 3, pp. 288–292, May 1997.

A. Stéphenne and B. Champagne, "Cepstral Prefiltering for Time Delay Estimation in Reverberant Environments", *Proceedings of the IEEE International Conference on Acoustics, Speech, and Signal Processing*, 1995, vol. 5, pp. 3055–3058.

Y. Huang, et al., "Adaptive Eigenvalue Decomposition Algorithm for Realtime Acoustic Source Localization System", *Proceedings of the IEEE International Conference on Acoustics, Speech, and Signal Processing*, 1999, vol. 2, pp. 937–940.

(Continued)

*Primary Examiner*—Xu Mei
*Assistant Examiner*—Brian T. Pendleton
(74) *Attorney, Agent, or Firm*—Fenwick & West LLP

(57) ABSTRACT

An acoustic source location technique compares the time response of signals from two or more pairs of microphones. For each pair of microphones, a plurality of sample elements are calculated that correspond to a ranking of possible time delay offsets for the two acoustic signals received by the pair of microphones, with each sample element having a delay time and a sample value. Each sample element is mapped to a sub-surface of potential acoustic source locations and assigned the sample value. A weighted value is calculated on each cell of a common boundary surface by combining the values of the plurality of sub-surfaces proximate the cell to form a weighted surface with the weighted value assigned to each cell interpreted as being indicative that a bearing vector to the acoustic source passes through the cell.

40 Claims, 14 Drawing Sheets

OTHER PUBLICATIONS

M. S. Brandstein, et al., "A Closed–Form Method for Finding Source Locations From Microphone–Array Time–Delay Estimates", *Proceedings of the IEEE International Conference on Acoustics, Speech, and Signal Processing*, 1995, vol. 5, pp. 3019–3022.

P. Svaizer, et al., "Acoustic Source Location in a Three–Dimensional Space Using Crosspower Spectrum Phase", *Proceedings of the IEEE International Conference on Acoustics, Speech, and Signal Processing*, 1997, vol. 1, pp. 231–234.

M. Omologo and P. Svaizer, "Acoustic Event Localization Using a Crosspower–spectrum Phase Based Technique", *Proceedings of the IEEE International Conference on Acoustics, Speech, and Signal Processing*, 1994, vol. 2, pp. II–273–II–276.

H. Silverman and S. Kirtman, "A Two–Stage Algorithm for Determining Talker Location From Linear Microphone Array Data", *Computer Speech and Language*, 1992, vol. 6, pp. 129–152.

M. Brandstein and H. Silverman, "A Practical Method for Speech Source Localization with Microphone Arrays", *Academic Press Unlimited*, 1997, pp. 91–126.

J. Flanagan, et al., "Computer–Steered Microphone Arrays for Sound Transduction in Large Rooms", J. *Acoust. Am.*, Nov. 1985, vol. 78, No. 5, pp. 1508–1518.

* cited by examiner

→ $\cos\alpha = \sin\theta\cos(\phi-\alpha)$

ACOUSTIC SOURCE LOCALIZATION SYSTEM AND METHOD

RELATED APPLICATIONS

This application claims the benefit of U.S. Provisional Application No. 60/247,138, entitled "Acoustic Source Direction By Hemisphere Sampling," filed Nov. 10, 2000, by Stanley T. Birchfield and Daniel K. Gillmor, the contents of which is hereby incorporated by reference in its entirety.

This application is also related to U.S. patent application Ser. No. 09/637,311, entitled "Audio and Video Notetaker," filed Aug. 10, 2000 by Rosenschein, et. al., assigned to the assignee of the present application, the entire contents of which is hereby incorporated herein by reference in its entirety.

BACKGROUND OF THE INVENTION

1. Field of the Invention

The present invention relates generally to techniques to determine the location of an acoustic source, such as determining a direction to an individual who is talking. More particularly, the present invention is directed towards using two or more pairs of microphones to determine a direction to an acoustic source.

2. Description of Background Art

There are a variety of applications for which it is desirable to use an acoustic technique to determine the approximate location of an acoustic source. For example, in some audio-visual applications it is desirable to use an acoustic technique to determine the direction to the person who is speaking so that a camera may be directed at the person speaking.

The time delay associated with an acoustic signal traveling along two different paths to reach two spaced-apart microphones can be used to calculate a surface of potential acoustic source positions. As shown in FIG. 1A, a pair of microphones 105, 110 is separated apart from each other by a distance D. The separation between the microphones creates a potential difference in acoustic path length of the two microphones with respect to the acoustic source 102. For example, suppose acoustic source 102 has a shorter acoustic path length, L1, to microphone 110 compared with the acoustic path length, L2, from acoustic source 102 to microphone 105. The difference in acoustic path length, ΔL=L2−L1, leads, in turn, to an offset in the time of arrival of the two acoustic signals received by each of the microphones 105 and 110. This time delay can be expressed mathematically as: $\Delta T_d=\Delta L/c$, where $\Delta T_d$ is the time delay of sound reaching the two microphones, ΔL is the differential path length from the acoustic source to the two microphones, and c is the speed of sound.

A particular time delay, $\Delta T_d$, has a corresponding hyperbolic equation defining a surface of potential acoustic source locations for which the differential path length (and hence $\Delta T_d$) is constant. This hyperbolic equation can be expressed in the x-y plane about the center line connecting a microphone pair as:

$$x^2/a^2-y^2/b^2=1$$

where $a=\Delta T_d/2$, b is the square root of $((D/2c)^2-a^2)$, and D is the microphone separation of the microphone pair. Beyond a distance of about 2D from the midpoint 114 between the microphones, the hyperboloid for a particular $\Delta T_d$ can be approximated by an asymptotical cone 116 with a fixed angle θ, as shown in FIG. 1B. The axis of the cone is co-axial with the line between the two microphones of the pair.

The cone of potential acoustic source locations associated with a single pair of spaced-apart microphones typically does not provide sufficient resolution of the direction to an acoustic source. Additionally, a single cone provides information sufficient to localize the acoustic source in only one dimension. Consequently, it is desirable to use the information from two or more pairs of microphone pairs to increase the resolution.

One conventional method to calculate source direction is the so-called "cone intersection" method. As shown in FIG. 2, four microphones may be arranged into a rectangular array of microphones consisting of a first pair of microphones 105, 110 and a second orthogonal pair of microphones 130 and 140. For each pair of microphones, a single respective cone 240, 250 of potential acoustic source locations is calculated. The cones intersect along two regions, although in many applications one of the intersection regions may be eliminated as an invalid solution or an algorithm may be used to eliminate one of the intersecting regions as an invalid intersection. The valid geometrical intersection of the two cones is then used to calculate a bearing line 260 indicating the direction to the acoustic source 102.

The cone intersection method provides satisfactory results for many applications. However, there are several drawbacks to the cone intersection method. In particular, the cone-intersection method is often not as robust as desired in applications where there is substantial noise and reverberation.

The intersection of cones method requires an accurate time delay estimate (TDE) in order to calculate parameters for the two cones used to calculate the bearing vector to the acoustic source. However, conventional techniques to calculate TDEs from the peak of a correlation function can be susceptible to significant errors when there is substantial noise and reverberation.

Conventional techniques to calculate the cross-correlation function do not permit the effects of noise and reverberation to be completely eliminated. For a source signal s(n) propagating through a generic free space with noise, the signal $x_i(n)$ acquired by the ith microphone has been traditionally modeled as follows:

$$x_i(n)=g_i*s(n-\tau_i)+\xi(n)$$

where $\alpha_i$ is an attenuation factor due to propagation loss, $\tau_i$ is the propagation time and $\xi_i(n)$ is the additive noise and reverberation. Reverberation is the algebraic sum of all the echoes and can be a significant effect, particular in small, enclosed spaces, such as office environments and meeting rooms. There are several techniques commonly used to calculate the cross-correlation of the two signals of ach microphone pair. The classical cross-correlation (CCC) function for each microphone pair, $C_{ij}$, can be expressed mathematically as $$C_{12}(\tau) = x_1(n) * x_2(n) = \sum_n x_1(n)x_2(n-\tau).$$

This is equivalent to $C_{12}(\tau)=F^{-1}\{X_1(f)X_2^*(f)\}$, where F denotes the Fourier transform. CCC requires the least computation of commonly used correlation techniques. However, in a typical office environment, reverberations from walls, furniture, and other objects broadens the correlation function, leading to potential errors in calculating the physical time delay from the peak of the cross-correlation function.

Filtering can improve the accuracy of estimating a TDE from a cross-correlation function. In particular, adding a pre-filter $\Psi(f)$ results in what is known as the generalized cross correlation (GCC) function, which can be expressed as:

$$R_{12}(\tau)=F^{-1}\{\Psi(f)X_1(f)X_2^*(f)\}$$

which describes a family of cross-correlation functions that include a filtering operation. The three most common choices of $\Psi(f)$ are classical cross-correlation (CCC), phase transform (PHAT), and maximum likelihood (ML). A fourth choice, normalized cross correlation (NCC), is a slight variant of CCC. PHAT is a prewhitening filter that normalizes the crosspower spectrum $\Psi(f)=1/(|X_i(f)X_j^*(f)|)$ to remove all magnitude information, leaving only the phase.

However, even the use of a generalized cross-correlation function does not always permit an accurate, robust determination of the TDEs used in the intersection of cones method. Referring again to FIG. 2, the intersection of cones method presumes that: 1) the TDE used to calculate the angle of each of the two cones is an accurate estimate of the physical time offset for acoustic signals to reach the two microphones of each pair from the acoustic source; and 2) the two cones intersect. However, these assumptions are not necessarily true. The TDE of each pair of microhones is estimated from the peak of the cross-correlation function and may have a significant error if the cross-correlation function is broadened by noise and reverberation. Additionally, in many real-world applications, there are "blind spots" associated with the fact that there are acoustic source locations for which the two cones do not have an intersection.

Therefore, there is a need for an acoustic location detection technique with desirable resolution that is robust to noise and reverberation.

SUMMARY OF THE INVENTION

An acoustic source location technique compares the time response of acoustic signals reaching the two microphones of each of two or more pairs of spaced-apart microphones. For each pair of microphones, a plurality of sample elements are calculated that correspond to a ranking of possible time delay offsets for the two acoustic signals received by the pair of microphones, with each sample element having a delay time and a sample value. Each sample element is mapped to a sub-surface of potential acoustic source locations appropriate for the separation distance and orientation of the microphone pair for which the sample element was calculated and assigned the sample value. A weighted value is calculated on each cell of a common boundary surface by combining the values of the plurality of sub-surfaces proximate the cell. The weighted cells form a weighted surface with the weighted value assigned to each cell interpreted as being indicative of the likelihood that the acoustic source lies in the direction of a bearing vector passing through the cell. In one embodiment, a likely direction to the acoustic source is calculated by determining a bearing vector passing through a cell having a maximum weighted value.

The features and advantages described in the specification are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The figures depict a preferred embodiment of the present invention for purposes of illustration only. One of skill in the art will readily recognize from the following discussion that alternative embodiments of the structures and methods disclosed herein may be employed without departing from the principles of the claimed invention.

DETAILED DESCRIPTION OF THE PREFERRED EMBODIMENTS

Figure 1A:
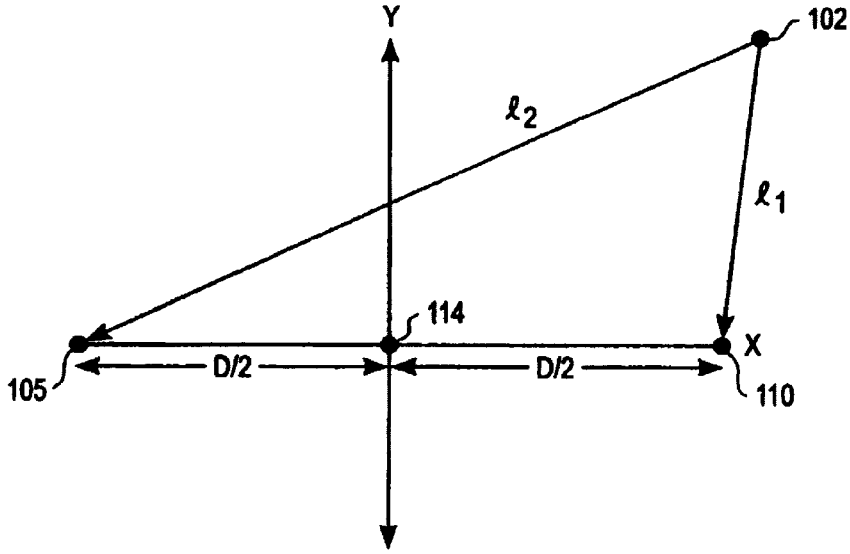
FIG. 1A (PRIOR ART)
FIG. 1A illustrates the difference in acoustic path length between two microphones of a pair of spaced-apart microphones.
Figure 1B:
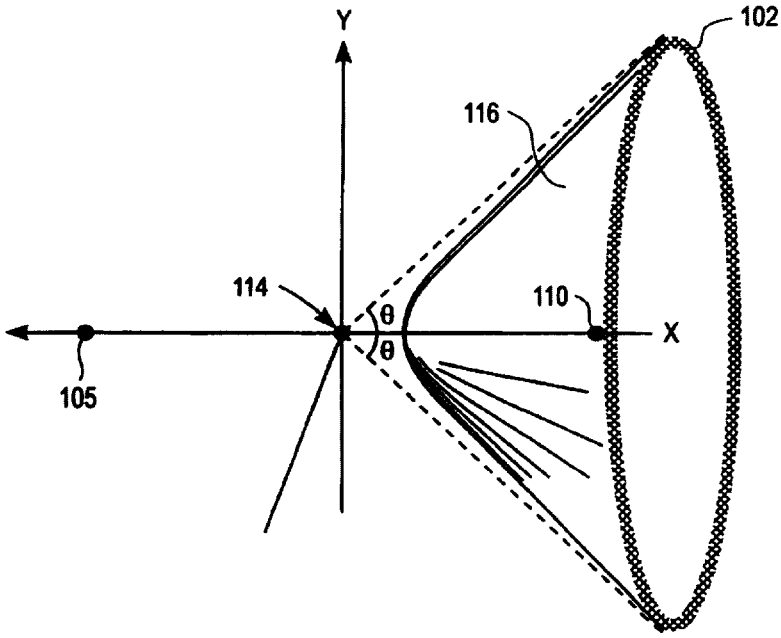
FIG. 1B (PRIOR ART)
FIG. 1B illustrates a hyperboloid surface corresponding to surface of potential acoustic source locations for a particular time offset associated with acoustic signals reaching the two microphones of a microphone pair.
Figure 2:
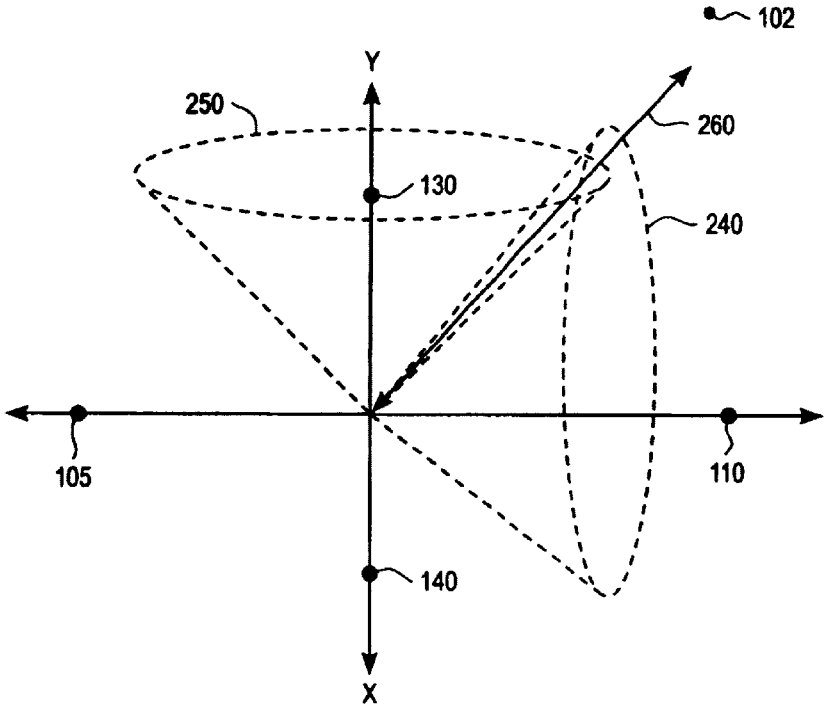
FIG. 2 (PRIOR ART)
FIG. 2 illustrates the conventional intersection of cones method for determining a bearing vector to an acoustic source.
Figure 3:
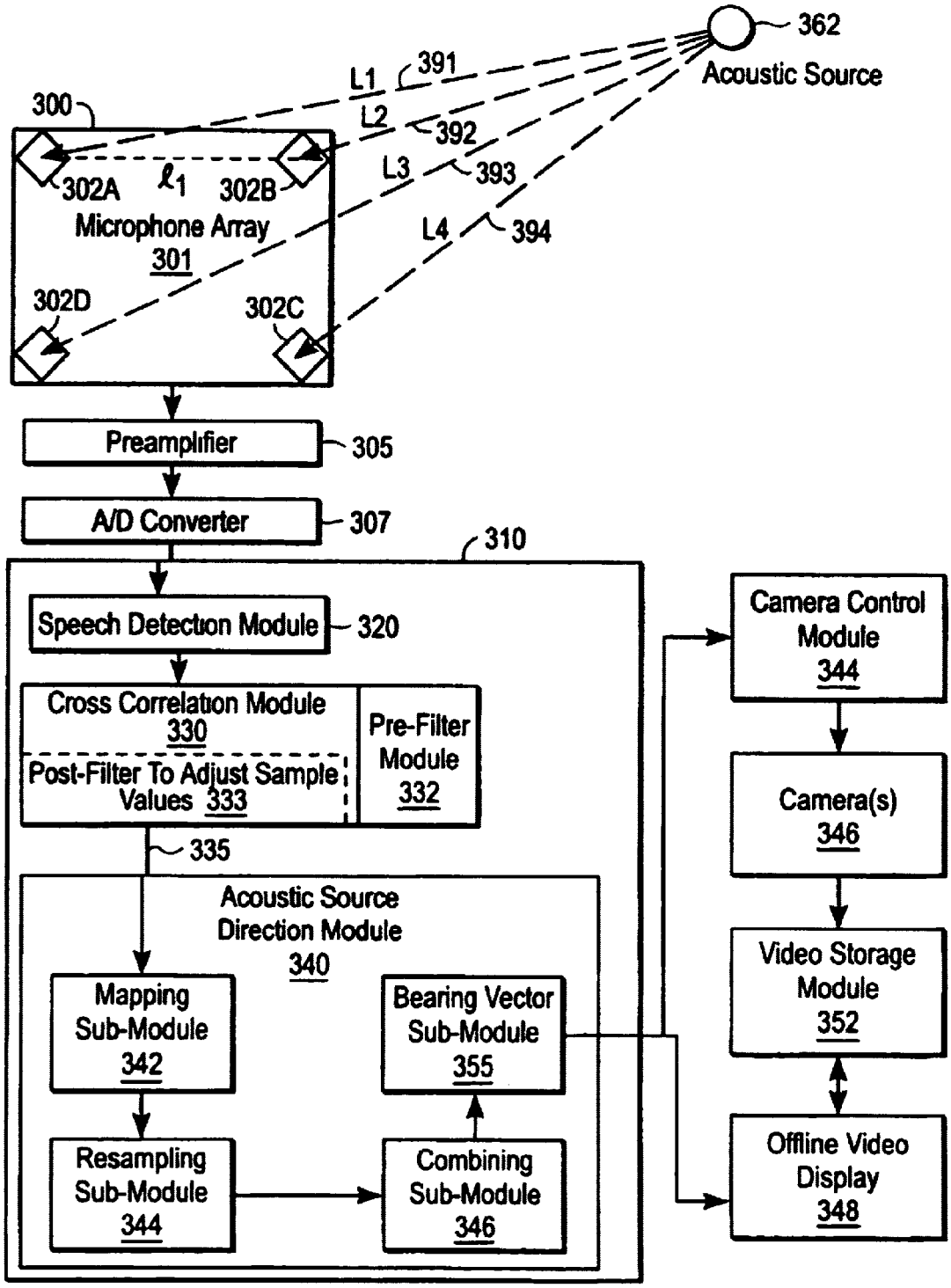
FIG. 3 illustrates a system for practicing the method of the present invention.

FIG. 3 is a block diagram illustrating one embodiment of an apparatus for practicing the acoustic source location method of the present invention. A microphone array 300 has three or more microphones 302 that are spaced apart from each other. Signals from two or more pairs of microphones 302 are used to generate information that can be used to determine a likely bearing to an acoustic source 362 from an origin 301. Since the microphones 302 are spaced apart, the distance Li from acoustic source 362 to each microphone may differ, as indicated by lines 391, 392, 393, and 394. Consequently, there will be a difference in the time response of acoustic signals reaching each of the two microphones in a pair due to differences in acoustic path length for acoustic signals to reach each of the two microphones of the pair.

Each pair of microphones has an associated separation distance between them and an orientation of its two microphones. For example, for the microphone pair consisting of microphones 302A and 302B, 11 defines a separation distance between them. The spatial direction of dashed line 11 relative to the x-y plane of microphone array 300 also defines a spatial orientation for the pair of microphones, relative some selected reference axis.

Microphone array 300 is shown having four microphones but may more generally have three or more microphones from which acoustic signals of two or more pairs of microphones may be selected. For example, in a system with four microphones A, B, C, and D signals from the microphones may be coupled to form pairs of signals from two or more of the microphone pairs A-C, B-D, A-B, B-C, C-D, and D-A. The microphones are preferably arranged symmetrically about a common origin 301, which simplifies the mathematical analysis. In a three microphone setup with microphones A, B, and C, pairs A-B and B-C would be sufficient.

The acoustic signals from each microphone 302 are preferably amplified by a pre-amplifier 305. To facilitate subsequent processing, the acoustic signals are preferably converted into digital representations using an analog-to-digital converter 307, such as a multi-channel analog-to-digital (A/D) converter 307 implemented using a conventional A/D chip, with each signal from a microphone 302 being a channel input to A/D 307.

Acoustic location analyzer 310 is preferably implemented as program code having one or more software modules stored on a computer readable medium (e.g., RAM, EEPROM, or a hard drive) executable as a process on a computer system (e.g., a microprocessr), although it will be understood that each module may also be implemented in other ways, such as by implementing the function in one or more modules with dedicated hardware and/or software (e.g., DSP, ASIC, FPGA). In one embodiment, acoustic location analyzer 310 is implemented as software program code residing on a memory coupled to an Intel PENTIUM III® chip.

In some applications it is desirable to determine the direction to a human speaker. Consequently, in one embodiment a speech detection module 320 is used to select only sounds corresponding to human speech for analysis. For example, speech detection module 320 may use any known technique to analyze the characteristics of acoustic signals and compare them with a model of human speech characteristics to select only human speech for analysis under the present invention.

In one embodiment a cross-correlation module 330 is used to compare the acoustic signals from two or more pairs of microphones. Cross-correlation software applications are available from many sources. For example, the Intel Corporation of Santa Clara, Calif. provides a cross-correlation application as part of its signal processing support library (available at the time of filing the instant application at Intel's developer library: http://developer.intel.com/software/products/perflib/). For each pair of microphones, the output of cross-correlation module 330 is a sequence of discrete sample elements (also commonly known as "samples") in accord with a discrete cross-correlation function, with each sample element having a time delay and a numeric sample value. Due to the presence of noise and reverberation, the two acoustic signals received by a pair of microphones typically have a cross-correlation function that has a significant magnitude of the sample value over a number of sample elements covering a range of time delays.

In one preferred embodiment, a pre-filter module 332 is coupled to cross-correlation module 330. In a preferred embodiment, pre-filter module 332 is a phase transform (PHAT) pre-filter configured to permit a generalized cross-correlation function to be implemented. As described below in more detail, it is desirable to filter human speech components of the acoustic signals prior to cross-correlation using a bandpass filter (not shown in FIG. 3), such as one with cutoff frequencies of about 3 and 4 kilohertz.

As described above, for each pair of microphones the output 335 of cross-correlation module 330 is a sequence of sample elements, with each sample element having a time delay and a numeric sample value. In the present invention, for each of the sample elements of a particular pair of microphones, the magnitude of the sample value of each sample element is interpreted as a measure of its relative importance to be used in determining the acoustic source location. In one embodiment the magnitude of the sample value is used as a direct measure of the relative importance of the sample element (e.g., if a first sample has a sample value with twice the magnitude of another sample element it has twice the relative importance in determining the location of the acoustic source). It will be understood that the sample value of a sample element does not have to correspond to an exact mathematical probability that the time delay of the sample element is the physical time delay. Additionally it will be understood that the magnitude of the sample value calculated from cross-correlation may be further adjusted by a post-filter module 333. As one example, a post filter module 333 could adjust the magnitude of each sample value by a logarithm function.

An acoustic source direction module 340 receives the sample elements of each pair of microphones. In one embodiment, the acoustic source direction module 340 includes a mapping sub-module 342 to map each sample element to a surface of potential acoustic source locations that is assigned the sample value, a resampling sub-module 344 to resample values on each cell of a common boundary surface for each pair of microphones, a combining module 346 to calculate a weighted value on each cell of the common boundary surface from the resampled data for two or more pairs of microphones, and a bearing vector sub-module 355 to calculate a likely direction to the acoustic source from a cell on the common boundary surface having a maximum weighted sample value. In one embodiment, mapping sub-module 342, resampling sub-module 344, and combining module 346 are implemented as software routines written in assembly language program code executable on a microprocessor chip, although other embodiments (e.g., DSP) could be implemented.

Figure 4:
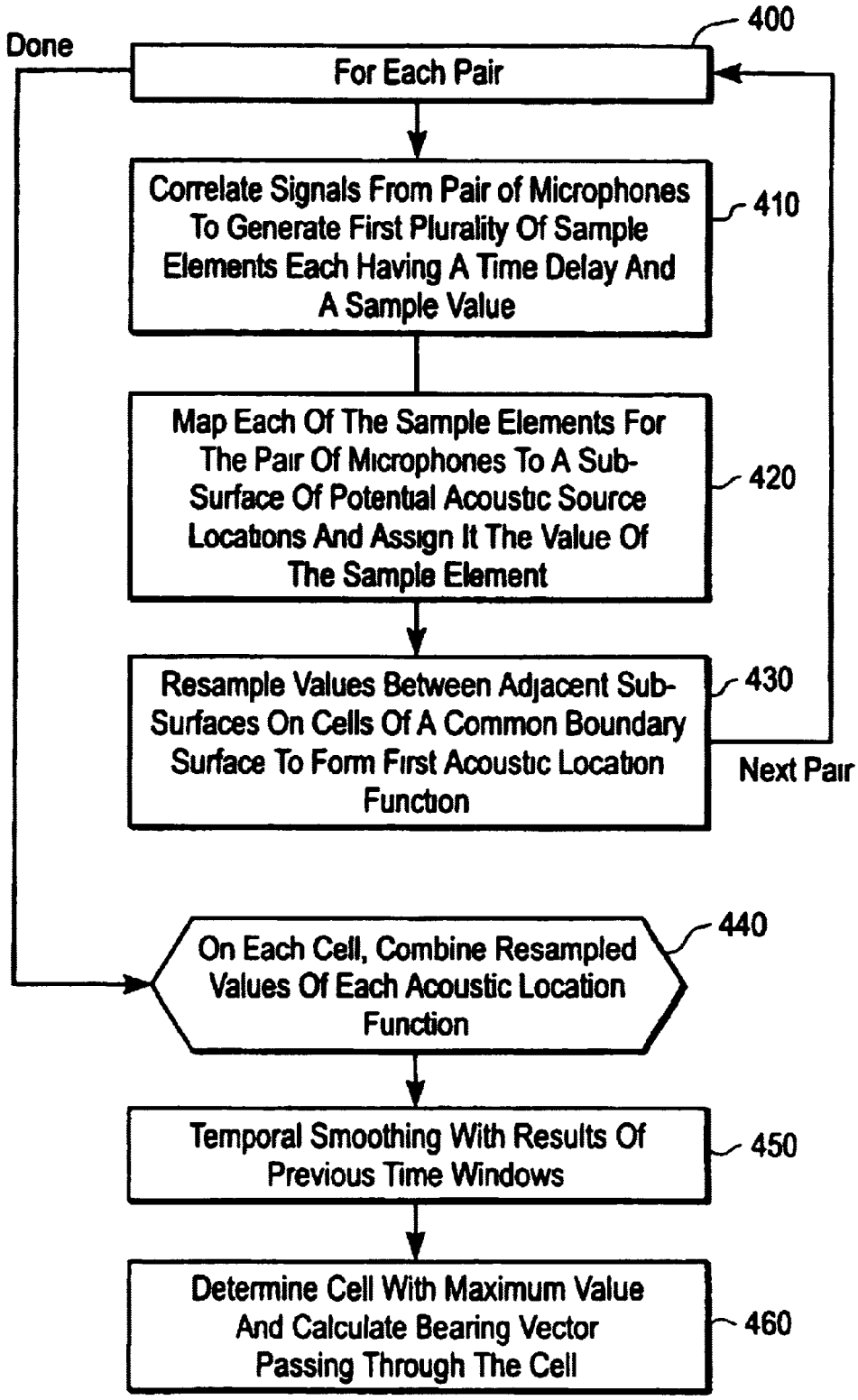
FIG. 4 is a flowchart of one method of determining acoustic source location.

The general sequence of mathematical calculations performed by acoustic location analyzer 310 are explained with reference to the flow chart of FIG. 4. As shown in the flow chart of FIG. 4, in a preferred embodiment, for each pair of microphones, the acoustic signals of the two microphones are cross-correlated 410 in cross-correlation module 330 resulting in a sequence of sample elements. For each pair of microphones, each of the sample elements calculated for the pair of microphones is mapped 420 to a sub-surface of potential acoustic source locations as a function of a separation distance between the microphones and orientation of the pair of microphones, and then assigned the sample value. This results in each pair of microphones having associated with it a sequence of sub-surfaces (e.g., a sequence of cones). The sample values are resampled 430 between adjacent cones proximate to each cell of a common boundary surface using an interpolation process. This results in each pair of microphones having a continuous acoustic location function along the common boundary surface. The resampled values for the acoustic location functions of two or more pairs of microphones are combined 440 on individual cells of the common boundary surface to form a weighted acoustic location function having a weighted value on each cell, with the weighted value being indicative of the likelihood that a bearing vector to the acoustic source passes through the cell. In one embodiment, the weighted acoustic location function of the most recent time window is temporally smoothed 450 with the weighted acoustic location function calculated from at least one previous time window, e.g., by using a decay function that smoothes the results of several time windows. A bearing vector to the acoustic source may be calculated 460 by determining a bearing vector from an origin of the microphones to a cell having a maximum weighted value.

Figure 5A:
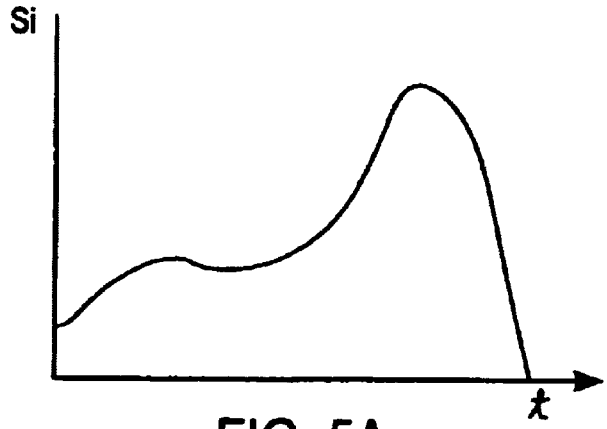
FIGS. 5A–5G illustrate some of the steps used in one embodiment for calculating a direction to an acoustic source.
Figure 5B:
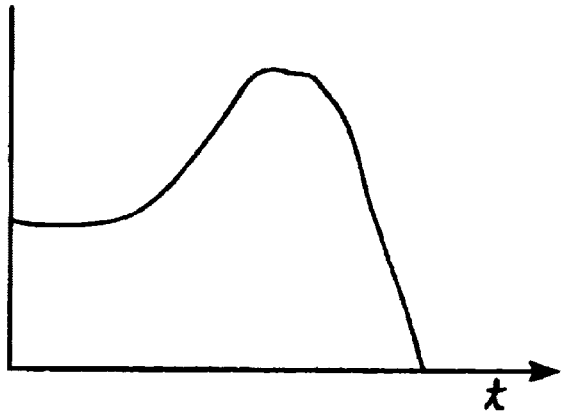

FIGS. 5A–H illustrate in greater detail some aspects of one embodiment of the method of the present invention. FIGS. 5A and 5B are illustrative diagrams of the acoustic signals received by two microphones of a pair of microphones. FIG. 5A shows a first signal Si and FIG. 5B shows a second signal Sj of two microphones, I and J, of a microphone pair during a time window. Note that the two acoustic signals are not necessarily pure time shifted replicas of each other because of the effects of noise and reverberation. Consequently, the cross-correlation may be comparatively broad with the sample elements having a significant magnitude over a range of possible time delays.

Figure 5C:
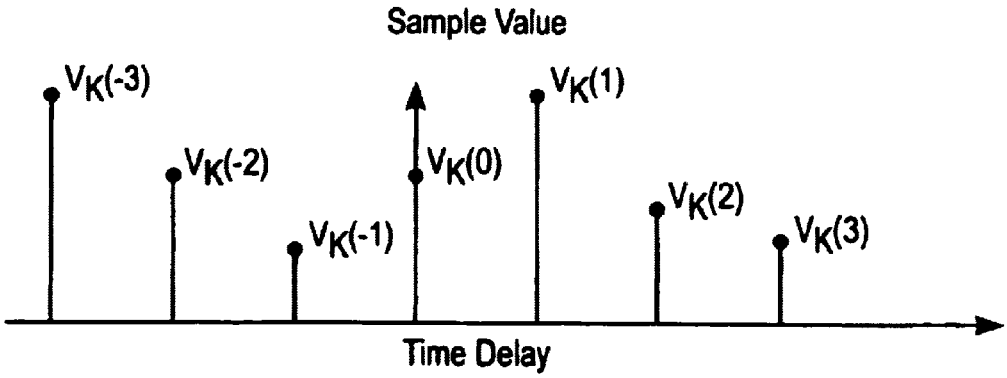

FIG. 5C illustrates the discrete correlation function $R_{ij}$, for signals Si and Sj for the pair of microphones I and J. The discrete correlation function is a sequence of discrete sample elements between the time delay values of $$-\left\lfloor \frac{dr}{c} \right\rfloor$$

to $$+\left\lfloor \frac{dr}{c} \right\rfloor,$$

where d is the separation distance between the microphones, r is the sample rate, and c is the speed of sound. Each sample element has a corresponding sample value $V_k$ and a time delay, $T_k$. For this case, the discrete correlation function can be expressed mathematically by the vector $$v_k, k = -\left\lfloor \frac{dr}{c} \right\rfloor, \ldots, \left\lfloor \frac{dr}{c} \right\rfloor,$$

where k corresponds to a sample number (e.g., 1, 2, 3, . . . ) and $$\left\lfloor \frac{dr}{c} \right\rfloor$$

is the maximum value of the range of k, where the spacing of the sample elements between the minimum and maximum values is determined by the number of sample elements. The maximum time delay, Δt, between sound from the acoustic source reaching the two microphones is $$|\Delta t| \leq \frac{d}{c},$$

where d is the distance between the microphones and c is the speed of sound. From the sampling theorem, a lowpass filter is preferably used so that all frequency components have a frequency greater than the inverse of $$t_{\max} = \frac{d}{c}.$$

The total number of sample elements in the discrete correlation function is $$2\left\lfloor \frac{dr}{c} \right\rfloor + 1$$

samples within each time window. In one embodiment, the time window is 50 milliseconds. For example, with d=15 cm, a sampling rate of 44 kHz yields 39 samples, while a sample rate of 96 kHz yields 77 samples.

Figure 5D:
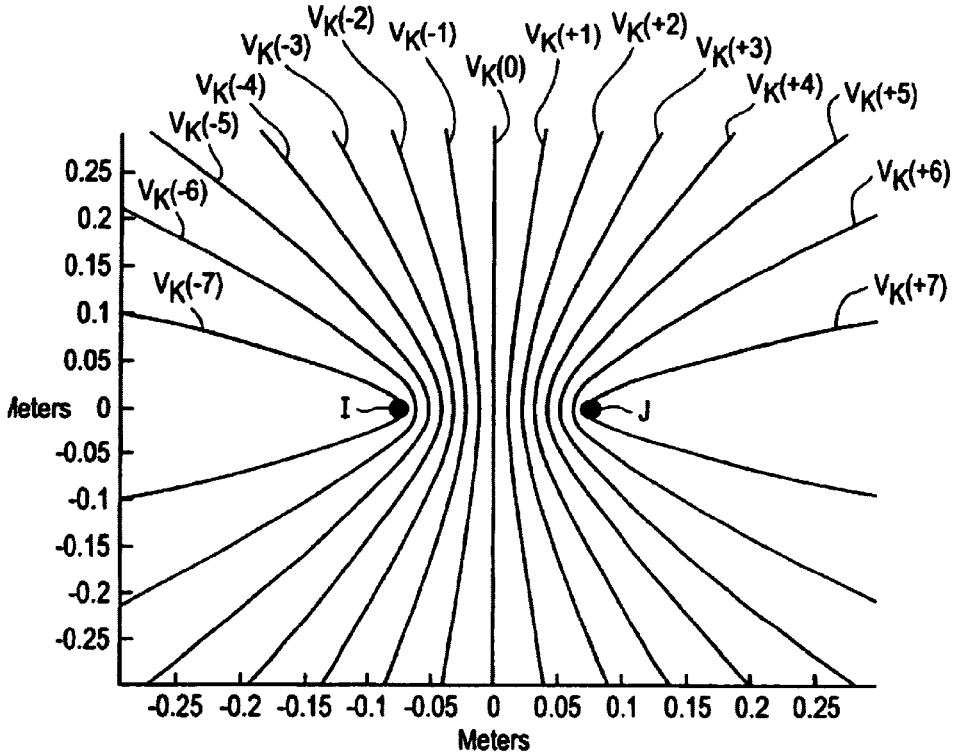
Figure 5E:
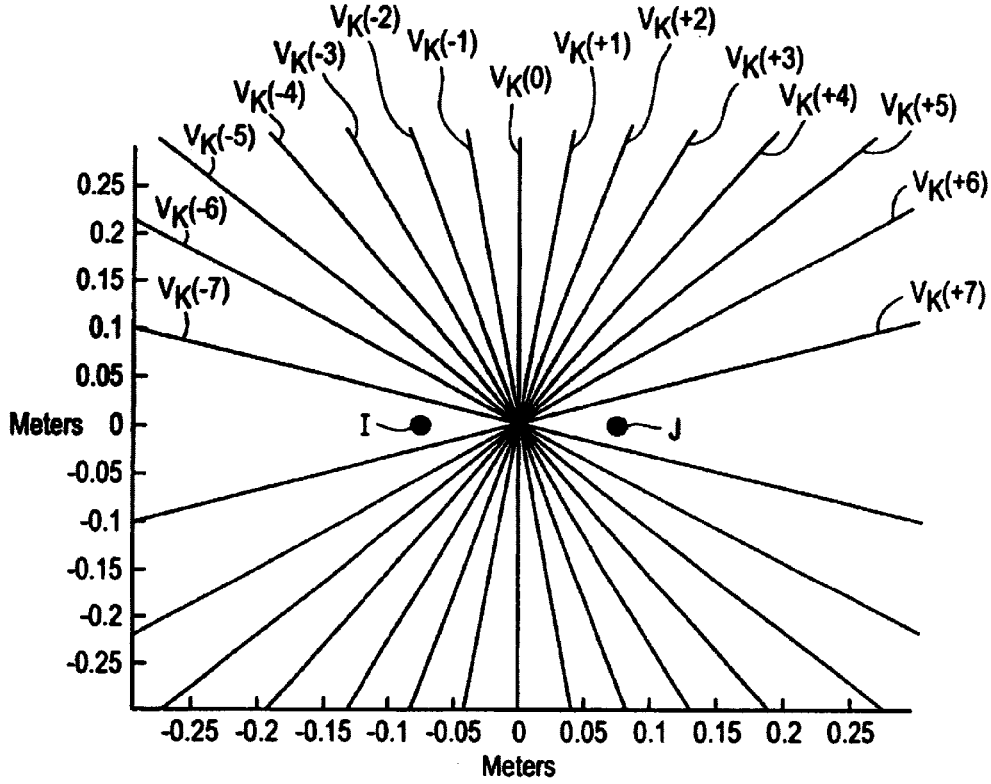
Figure 5F:
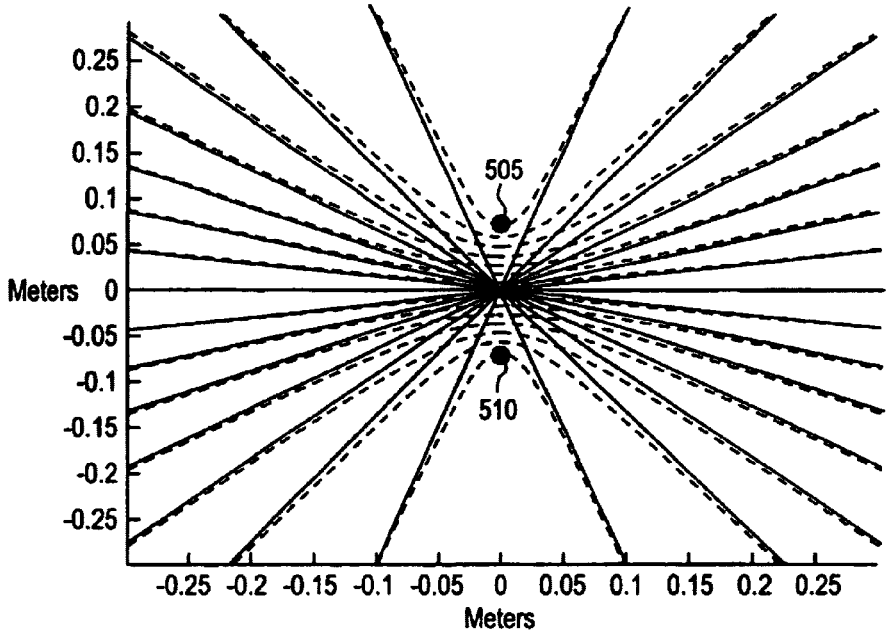

Referring to FIG. 5D, for each sample element calculated for microphones I and J, a sub-surface of potential acoustic source locations can be calculated from the time delay of the sample element and the orientation and separation distance of the microphone pair, with the sub-surface assigned the sample value of the sample element. The sub-surfaces correspond to hyperbolic surfaces. Thus, in one embodiment the relative magnitude of each sample, Vk, is interpreted to be a value indicative of the likelihood that the acoustic source is located near a half-hyperboloid centered at the midpoint between the two microphones I and J with the parameters of the hyperboloid calculated assuming that $T_k$ is the correct time delay. As shown in FIG. 5F, for distances sufficiently far from the microphones (e.g., a distance approximately 2d from the center, where d is the separation between the pair of microphones), the half-hyperboloid for a particular $T_k$ is well approximated by the asymptotical cone having an angle, α of:

$$\alpha_k = \cos^{-1}\left(\frac{ck}{dr}\right) \tag{1}$$

with respect to the axis of symmetry along the line connecting the microphones.

Figure 5G:
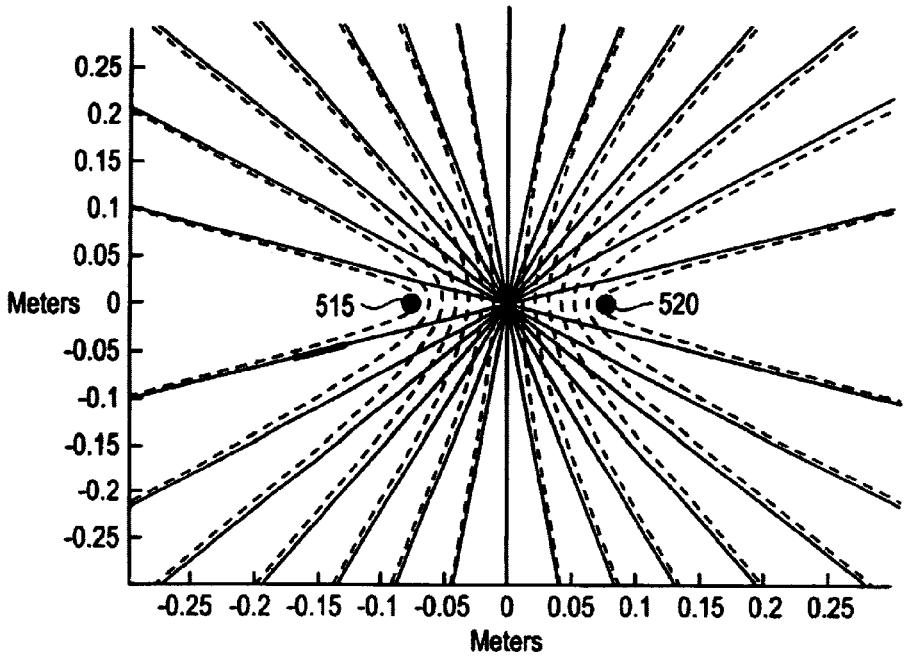

FIG. 5F and FIG. 5G show examples of the sequence of cones calculated for two orthogonal pairs of microphones arranged as a square-shaped array with the microphones shown at 505, 510, 515, and 520. The dashed lines indicate the hyperbolic surfaces and the solid lines are the asymptotic cones. In this example, there are 15 sample elements (15 cones) for each of the two pairs of microphones. Increasing the number of sample elements (e.g., by increasing the sample rate) acts to reduce the separation of the cones. The number of sample elements desired for a particular application will depend upon the desired angular resolution. Although neighboring cones are not uniformly separated, the average angular separation between neighboring cones is approximately 180 degrees divided by the number of sample elements. Thus one constraint is that the number of samples be selected so that the average cone separation (in degrees) is less than the desired angular cell resolution. However, since the average cone separation is often larger along the line connecting the pair of microphones, another useful constraint is that the number of samples is selected so that the average cone separation is less than half the desired angular cell resolution.

Figure 6A:
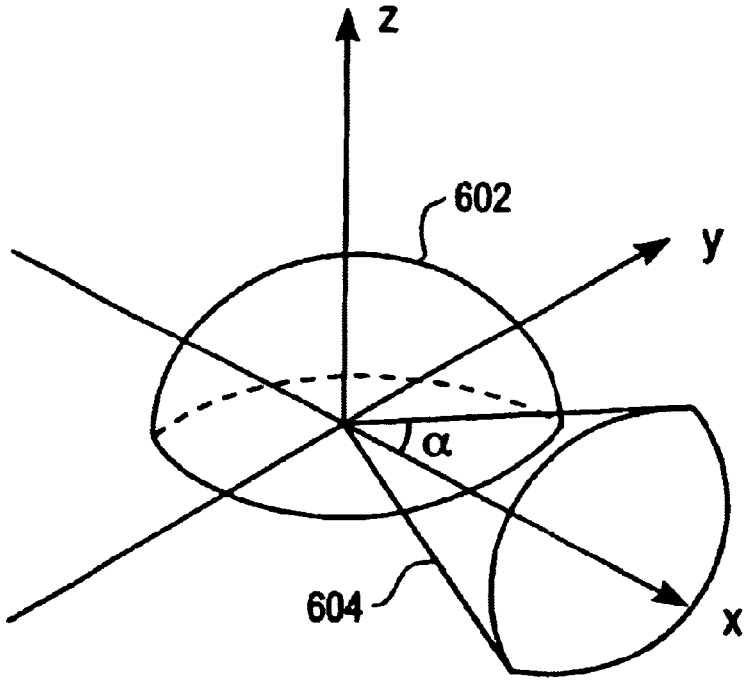
FIGS. 6A–6E illustrate the geometry of a preferred method of mapping cones to a hemisphere.
Figure 6B:
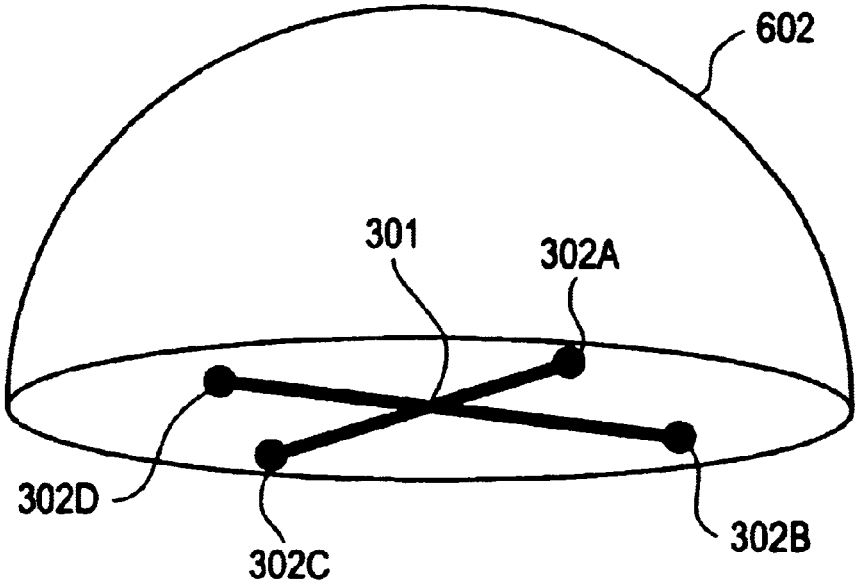

As shown in FIG. 6A, in one embodiment the common boundary surface for the asymptotic cones is a hemisphere 602 with the intersection of one cone 604 with the hemisphere 602 corresponding to a circular-shaped intersection. Thus, each pair of microphones has its sequence of cones mapped as a sequence of spaced-apart circles along the hemisphere. The values between adjacent circles on the hemisphere can be calculated using an interpolation method, which corresponds to a resampling process (e.g., calculating a resampled value on cells proximate adjacent circles). As shown in FIG. 6B, a preferred technique is to map the sequence of cones from a particular pair of microphones to a boundary surface that is a hemisphere 602 (corresponding to step 420) centered about the origin 301 of the spaced-apart microphones 302 and then to interpolate values between the cones on cells (not shown in FIG. 6B) of the hemisphere 602 (corresponding to step 430), with each cell covering a solid angle preferably less than the desired acoustic source resolution.

Mapping the cones of the two coincident microphone pairs 302B–302D and 302A–302C to the surface of hemisphere 602 is comparatively simple because these pairs have midpoints coincident with origin 301 of hemisphere 602. Consequently, for the coincident pairs all the cones have vertices at origin 301 and can therefore be mapped to a common hemispherical coordinate system centered at point 301, without knowing the distance to the sound source.

Figure 6C:
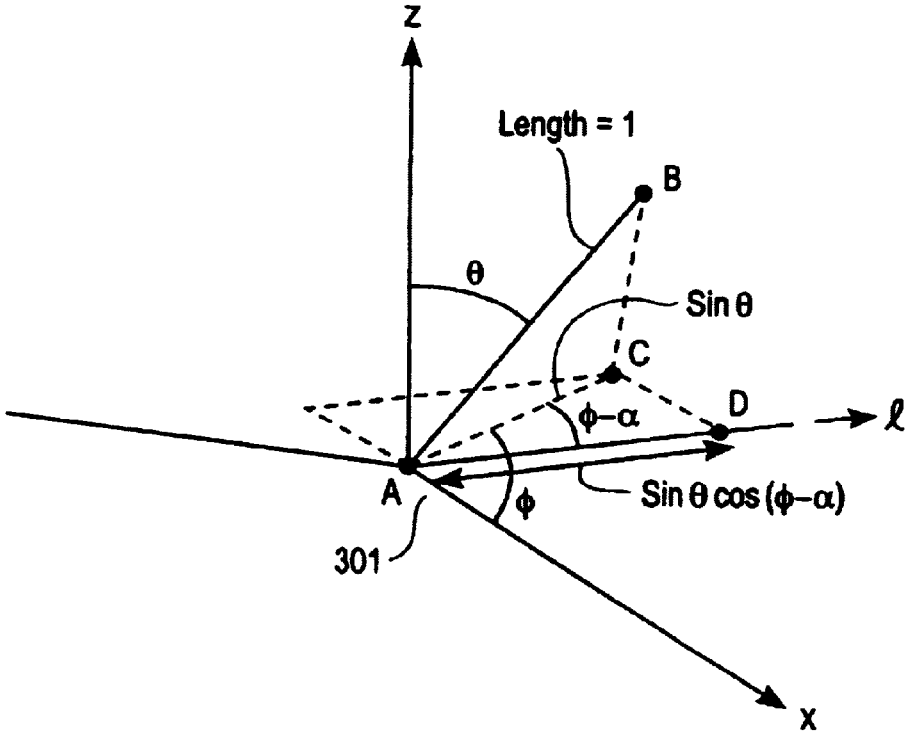

Let $h_p$ be defined as an acoustic location function defined on the unit hemisphere such that $h_p(\theta,\phi)$ is a continuous function indicative of the likelihood that the sound source is located in the $(\theta,\phi)$ direction, given the discrete correlation function for a microphone pair p. As shown in FIG. 6C, the angles are those of a spherical coordinate system, so that $\theta$ is the angle with respect to the z axis, and $\phi$ is the angle, in the xy plane, with respect to the x axis. Let l be the line connecting the two microphones and defining a separation distance, d, and an orientation for the pair of microphones, and let $\gamma$ be the angle between l and the x axis. For the opposing pairs, then, $\gamma=0$ and $$\gamma = \frac{\pi}{2}.$$

To determine $h_p(\theta,\phi)$, we first compute the angle between l and the ray designated by $(\theta,\phi)$:

$$\alpha=\cos^{-1}(\sin\theta\cos(\phi-\gamma)). \tag{2}$$

Figure 6D:
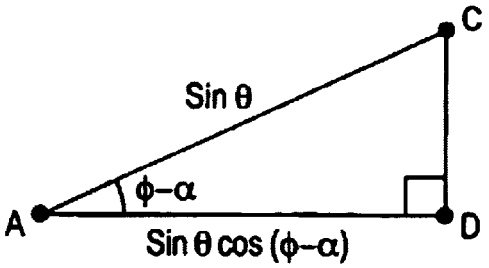
Figure 6E:
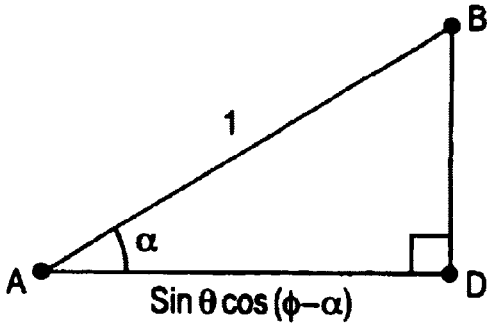

The geometry of this transformation is further illustrated in FIG. 6D and FIG. 6E. Since every asymptotical cone intersects the hemisphere along a semicircle parallel to the z axis, we can linearly interpolate along the surface of the hemisphere between the two cones nearest $\alpha$:

$$h_p(\theta,\phi) = \frac{(\alpha_{k+1}-\alpha)v_k + (\alpha-\alpha_k)v_{k+1}}{\alpha_{k+1}-\alpha_k}, \tag{3}$$

where k is obtained by inverting Eq. (1) to obtain:

$$k = \left\lfloor \frac{dr}{c}\cos\alpha \right\rfloor.$$

The four non-coincident pairs of microphones of the square array can also be used, although additional computational effort is required to perform the mapping since the midpoint of a non-coincident pairs 302A–302B, 302B–302C, 302C–302D, and 302D–302A is offset from the origin 301 of the unit hemisphere. For the non-coincident pairs of microphones, in order to compute $h_p(\theta,\phi)$, the point $(\theta,\phi,\rho)$ is converted to rectangular coordinates, the origin is shifted by $$\pm\frac{d}{4}$$

in the x and y directions, and the point is converted back to spherical coordinates to generate a new $\theta$ and $\phi$. Then Eqs. (2) and (3) are used, with $$\gamma = \pm\frac{\pi}{4} \text{ or } \pm\frac{3\pi}{4}.$$

The mapping required for the non-coincident pairs requires an estimate of the distance $\hat{\rho}$ to the sound source. This distance can be set at a fixed distance based upon the intended use of the system. For example, for use in conference rooms, the estimated distance may be assumed to be the width of a conference table, e.g., about one meter. However, even in the worst case the error introduced by an inaccurate choice for the distance to the acoustic source tends to be small as long as the microphone separation, d, is also small.

Figure 7A:
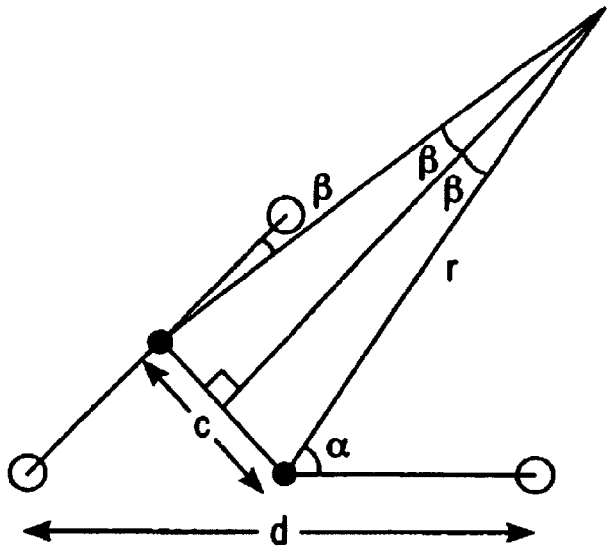
FIG. 7A illustrates the geometry for calculating the error in mapping cones from a non-coincident pair of microphones to a hemisphere.
Figure 7B:
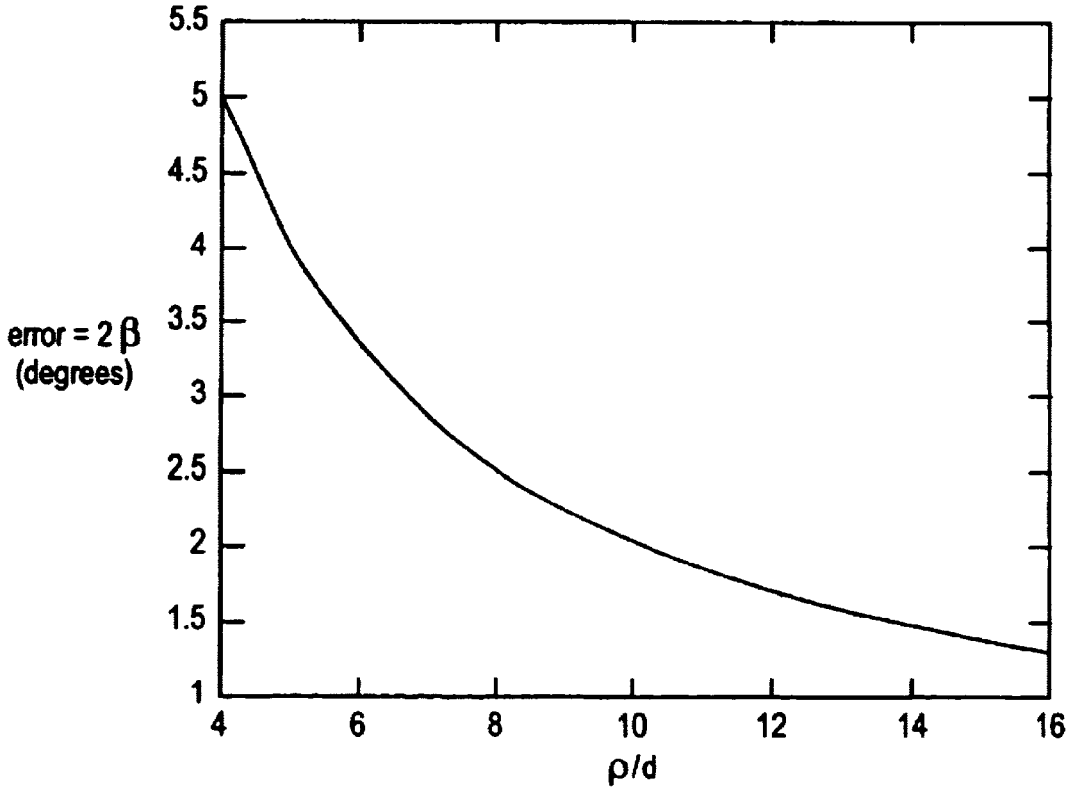
FIG. 7B is a plot of relative error for using non-coincident pairs of microphones.

FIG. 7A illustrates the geometry for calculating the error for non-coincident pairs for selecting an inappropriate distance to the acoustic source and FIG. 7B is a plot of the error versus the ratio $\rho/d$ . The azimuthal error is bounded $(\hat{\rho}=\infty)$ by:

$$\phi-\hat{\phi} = 2\beta = 2\sin^{-1}\left(\frac{\varepsilon}{2\rho}\right) = 2\sin^{-1}\left(\frac{d}{\rho(4\sqrt{2})}\right).$$

Notice that, in the worst case that if the sound source is at least 4d from the array, the error is less than 5.1 degrees. With a better distance estimate, the error becomes even smaller. Thus, even if the distance to the acoustic source is not known or is larger than an estimated value, the error in using the non-coincident pairs may be sufficiently small to use the data from these pairs.

Figure 8:
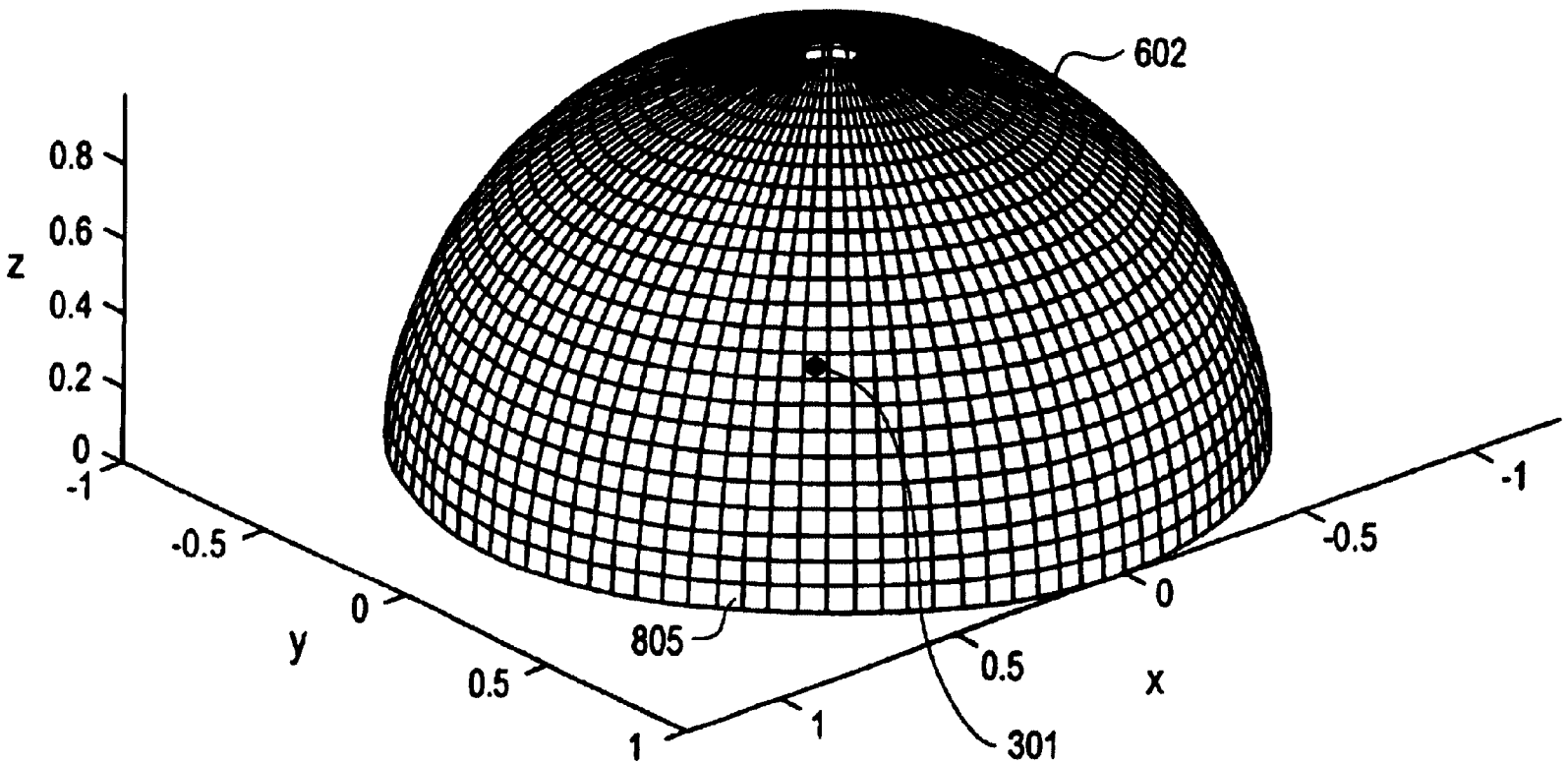
FIG. 8 illustrates a common boundary surface that is a unit hemisphere having cells spaced at equal latitudes and longitudes around the hemisphere.

As shown in FIG. 8, for each microphone pair p, the function $h_p$ is preferably computed at discrete points on a set of cells 805 of hemisphere 602 regularly spaced at latitudes and longitudes around the hemisphere 602. The dimension of the cells are preferably selected to correspond to each cell having a desired resolution, e.g., cells encompassing a range of angles less than or equal to the resolution limit of the system.

A weighted acoustic location function may be calculated by the summing the resampled value on each cell of the acoustic location function calculated for each of the individual P microphone pairs:

$$h(\theta,\phi) = \sum_{p=1}^{P} h_p(\theta,\phi).$$

The direction to the sound source can then be calculated by selecting a direction bearing vector from origin 301 to a cell 805 on the unit hemisphere 602 having the maximum weighted value. This can be expressed mathematically as:

$$(\theta,\phi)=arg\max h(\theta,\phi).$$

As previously discussed, in one embodiment temporal smoothing is also employed. In one embodiment using temporal smoothing a weighted fraction of the combined location function of the current time window (e.g., 15%) is combined with a weighted fraction (e.g. 85%) of a result from at least one previous time window. For example, the result from previous time windows may include a decay function such that the temporally smoothed result from the previous time window is decayed in value by a preselected fraction for the subsequent time window (e.g., decreased by 15%). The direction vector is calculated from the temporally smoothed combined angular density function. Moreover, if the temporal smoothing has a relatively long time constant (e.g., a half-life of one minute) then in some cases it may be possible to form an estimate of the effect of a background sound source to improve the accuracy of the weighted acoustic location function. A stationary background sound source, such as a fan, may have an approximately constant maximum sound amplitude. By way of contrast, the amplitude of human speech changes over time and human speakers tend to shift their position. The differences between stationary background sound sources and human speech permits some types of background noise sources to be identified by a persistent peak in the weighted acoustic source location function (e.g., the weighted acoustic location function has a persistent peak of approximately constant amplitude coming from one direction). For this case, an estimation of the contribution to the weighted acoustic location function made by the stationary background noise source can be calculated and subtracted in each time window to improve the accuracy of the weighted acoustic location function in regards to identifying the location of a human speaker.

It will be understood that the data generated by a system implementing the present invention may be used in a variety of different ways. Referring again to FIG. 3, direction information generated by acoustic source direction module 340 may be used as an input by a real-time camera control module 344 to adjust the operating parameters of one or more cameras 346, such as panning the camera towards the speaker. Additionally, a bearing direction may be stored in an offline video display module 348 as metadata for use with stored video data 352. For example, the direction information may be used to assist in determining the location of the acoustic source 362 within stored video data.

One benefit of the method of the present invention is that it is robust to the effects of noise and reverberation. As previously discussed, noise and reverberation tend to broaden and shift the peak of the cross-correlation function calculated for the acoustic signals received by a pair of microphones. In the conventional intersection of cones method, the two intersecting cones are each calculated from the time delay associated with the peak of two cross-correlation functions. This renders the conventional intersection of cones method more sensitive to noise and reverberation effects that shift the peak of the cross-correlation function. In contrast, the present invention is robust to changes in the shape of the cross-correlation function because: 1) it can use the information from all of the sample elements of the cross-correlation for each pair of microphones; and 2) it combines the information of the sample elements from two or more pairs of microphones before determining a direction to the acoustic source, corresponding to the principle of least commitment in that direction decisions are delayed as long as possible. Consequently, small changes in the shape of the correlation function of one pair of microphones is unlikely to cause a large change in the distribution of weighted values on the common boundary surface used to calculate a direction to the acoustic source. Additionally, robustness is improved because the weighted values can include the information from more than two pairs of microphones (e.g., six pairs for a square configuration of four microphones) further reducing the effects of small changes in the shape of the cross-correlation function of one pair of microphones. Moreover, temporal smoothing further improves the robustness of the method since each cell can also include the information of several previous time windows, further reducing the sensitivity of the results to the changes in the shape of the correlation function for one pair of microphones during one sample time window.

Another benefit of the method of the present invention is that it does not have any blind spots. The present invention uses the information from a plurality of sample elements to calculate a weighted value on each cell of a common boundary surface. Consequently, a bearing vector to the acoustic source can be calculated for all locations of the acoustic source above the plane of the microphones.

Still another benefit of the method of the present invention is that its computational requirements are comparatively modest, permitting it to be implemented as program code running on a single computer chip. This permits the method of the present invention to be implemented in a compact electronic device.

While particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein without departing from the spirit and scope of the invention as defined in the appended claims.

What is claimed is:

1. A method of forming information for determining a direction of an acoustic source using at least three spaced-apart microphones, the microphones coupling acoustic signals from at least two pairs of microphones with each pair of microphones receiving two acoustic signals and having a separation distance and an orientation of its two microphones, the method comprising:

for each pair of microphones, calculating a plurality of sample elements for the two acoustic signals received by the pair of microphones, the plurality of sample elements corresponding to a ranking of possible time delays between the two acoustic signals received by the pair of microphones with each sample element having a time delay and a numeric sample value;

for the plurality of sample elements of each pair of microphones, mapping each sample element to a sub-surface of potential acoustic source locations according to its time delay and the orientation and the separation distance of the pair of microphones for which the sample element was calculated, and assigning the sub-surface the sample value of the sample element, producing a plurality of sub-surfaces for each pair of microphones;

for a boundary surface intersecting each of the plurality of sub-surfaces, the boundary surface divisible into a plurality of cells, calculating a weighted value in each cell of the boundary surface by combining the sample values of the plurality of sub-surfaces proximal the cell to form a weighted surface with the weighted value of each cell of the weighted surface being indicative of the likelihood that the acoustic source lies in a direction of a bearing vector passing through the cell.

2. The method of claim 1, further comprising:

calculating a likely direction to the acoustic source by determining the bearing vector to the cell of the weighted surface having a maximum magnitude.

3. The method of claim 2, further comprising:

storing the likely direction as metadata of an audio-visual event associated with the generation of the acoustic signals.

4. The method of claim 2, wherein the likely direction is used to select a camera view of the acoustic source.

5. The method of claim 2, wherein the likely direction is used to control a camera view of the acoustic source.

6. The method of claim 2, wherein the likely direction is stored as metadata for a visual recording of the acoustic source.

7. The method of claim 1, further comprising: storing the weighted values.

8. The method of claim 1, wherein the plurality of sample elements of each pair of microphones is calculated by cross-correlating the acoustic signals received by the pair of microphones during a time window.

9. The method of claim 8, further comprising:

pre-filtering the acoustic signals prior to cross-correlation.

10. The method of claim 8, wherein cross-correlating is performed using a generalized cross-correlation function.

11. The method of claim 1, wherein each sub-surface of potential acoustic source locations is a hyperboloid.

12. The method of claim 1, wherein each sub-surface of potential acoustic source locations is a cone.

13. The method of claim 12, wherein calculating the weighted value in each cell further comprises:

for each pair of microphones, interpolating the sample values between neighboring sub-surfaces on each cell of the boundary surface to form for each pair of microphones an acoustic location function having a resampled value on each cell; and in each cell, combining the resampled values of each of the acoustic location functions.

14. The method of claim 13, wherein in each cell the resampled values are combined by summing the resampled values of each of the acoustic location functions on the cell.

15. The method of claim 1, wherein there are three or more pairs of microphones.

16. The method of claim 1, wherein there are four microphones and two pairs of microphones.

17. The method of claim 1, wherein there are four microphones and six pairs of microphones.

18. The method of claim 1, wherein the boundary surface is a hemisphere.

19. A method of forming information for determining the location of an acoustic source using at least three spaced-apart microphones, the microphones coupling acoustic signals from at least two pairs of microphones with each pair of microphones receiving two acoustic signals and having a separation distance and an orientation of its microphones, the method comprising:

for each pair of microphones, cross-correlating the two acoustic signals received by the pair of microphones to produce a plurality of sample elements with each sample element having a time delay and a sample value;

for each sample element of the plurality of sample elements associated with each pair of microphones, mapping the sample element to a cone of potential acoustic source locations appropriate for the time delay of the sample element and the separation distance and the orientation of the pair of microphones for which the sample element was calculated and assigning the cone the sample value of the sample element, forming a sequence of cones for each pair of microphones;

for each pair of microphones, mapping the sequence of cones associated with the pair of microphones to a boundary surface divisible into a plurality of cells and interpolating the sample values between adjacent cones to form a continuous acoustic location function on the boundary surface having a resampled value in each cell, thereby forming a plurality of acoustic location functions; and in each cell, combining the resampled value of each of the acoustic location functions to form a weighted acoustic location function having a weighted value in each cell indicative of the likelihood that the acoustic source lies in a direction of a bearing vector passing through the cell.

20. The method of claim 19, further comprising:

pre-filtering the signals prior to cross-correlation.

21. The method of claim 20, wherein the pre-filtering is performed using a phase transform filter.

22. The method of claim 19, wherein the resampled values are combined in each cell by summing the resampled values on the cell.

23. The method of claim 22, wherein the boundary surface is a hemisphere.

24. The method of claim 23, wherein there are four microphones arranged as a rectangular array with one microphone disposed on each corner of a rectangle and the hemisphere has an origin coincident with the center of the rectangle.

25. The method of claim 24, wherein the pairs of microphones are two pairs of microphones with each of the two pairs of microphones having a midpoint coincident with the origin of the hemisphere.

26. The method of claim 25, further comprising: at least one additional pair of microphones having a midpoint non-coincident with the origin of the hemisphere.

27. The method of claim 26, wherein there are four non-coincident pairs of microphones.

28. The method of claim 19, further comprising:

temporally smoothing the weighted acoustic location function of one time window with the weighted acoustic location function of at least one previous time window.

29. The method of claim 19, wherein a sample rate and the separation distance between the two microphones of each pair of microphones is selected so that the number of sample elements for each pair of microphones is greater than 90° divided by a desired cell resolution in degrees.

30. The method of claim 29, wherein the number of sample elements is greater than 180° divided by a desired cell resolution in degrees.

31. A method of forming information for determining the location of an acoustic source using at least three spaced-apart microphones, the microphones coupling signals from at least two pairs of microphones with each pair of microphones receiving two acoustic signals and having a separation distance and an orientation of its microphones, the method comprising:

for each pair of microphones, cross-correlating the two acoustic signals received by the pair of microphones to produce a sequence of discrete sample elements for the pair of microphones with each sample element having a time delay and a sample value;

for each pair of microphones, mapping each sample element of its sequence of sample elements to a cone of potential acoustic source locations appropriate for the time delay of the sample element and the orientation and separation distance of the pair of microphones for which the sample element was calculated, and assigning the cone the sample value, thereby forming for each pair of microphones a sequence of cones;

for each pair of microphones, mapping its sequence of cones to a hemisphere divisible into a plurality of cells and interpolating sample values between adjacent cones to form for each pair of microphones an acoustic location function having a resampled value on each cell of the hemisphere; and forming a weighted acoustic location function having a weighted value in each cell by combining in each cell the resampled values of each of the acoustic location functions, the weighted value of each cell being indicative of the likelihood that the acoustic source lies in a direction of a bearing vector passing through the cell.

32. The method of claim 31, wherein a sample rate and a separation between microphones of each pair of microphones is selected so that the number of sample elements for each microphone pair is greater than ninety degrees divided by a desired cell resolution in degrees.

33. The method of claim 31, further comprising:

selecting a cell having a maximum value; and calculating the bearing direction from an origin of the microphones that extends in a direction through the cell having the maximum value.

34. The method of claim 31, further comprising:

temporally smoothing the combined acoustic location function of a current time window with a result from at least one previous time window.

35. A system for generating data regarding the location of an acoustic source, comprising:

at least three microphones coupled to provide acoustic signals from at least two pairs of microphones with each pair of microphones consisting of two microphones receiving two acoustic signals and having a separation distance and an orientation;

an analog-to-digital converter adapted to sample the acoustic signals at a preselected rate and to convert the acoustic signals into digital representations of the acoustic signals;

a correlation module receiving the digital representations of the acoustic signals and outputting for each pair of microphones a sequence of discrete sample elements with each sample element having a time delay and a sample value; and an acoustic source direction module receiving the sample elements configured to form a weighted acoustic location function on a boundary surface, the acoustic source direction module comprising:

a mapping sub-module mapping each sample element to a cone of potential acoustic source locations appropriate for the time delay of the sample element and the separation distance and the orientation of the pair of microphones for which the sample element was calcualted and assigning each cone the sample value;

a resampling sub-module adapted to interpolate the sample values between adjacent cones of each pair of microphones on the boundary surface, the resampling module forming an acoustic location function for each pair of microphones that has a resampled value on each cell of the boundary surface; and a combining sub-module configured to combine the resampled values of the acoustic location function on each cell into a weighted value for the cell that is indicative of the likelihood that the acoustic source lies along in the direction of a bearing vector passing through the cell.

36. The system of claim 35, further comprising:

a speech detection module configured to limit directional analysis to acoustic sources that are human speakers.

37. The system of claim 35, further comprising:

at least one camera;

a video storage module for storing video data from the at least one camera; and an offline storage module for receiving and storing acoustic source direction data from the acoustic source direction module.

38. The system of claim 35 wherein the mapping sub-module, resampling sub-module, and combining sub-module comprise program code residing on a memory of a computer.

39. A system for generating data regarding the location of an acoustic source, comprising:

a plurality of pairs of microphones;

correlation means for producing for each pair of microphones a sequence of discrete sample elements with each sample element having a time delay and a sample value; and acoustic source direction means receiving the sample elements and calculating a weighted value on each of a plurality of cells of a common boundary surface, the weighted value on each cell being indicative of the likelihood that the acoustic source lies in a bearing direction passing through the cell.

40. A computer program product for forming information for determining a direction to an acoustic source from the acoustic signals of at least three microphones coupled to provide acoustic signals from at least two pairs of microphones with each pair of microphones consisting of two microphones receiving two acoustic signals and having a separation distance and an orientation, the computer program product comprising:

a computer readable medium;

a cross-correlation module stored on the computer readable medium, and configured to receive a digital representation of the acoustic signals and outputting for each pair of microphones a sequence of sample elements with each sample element having a time delay and a sample value; and an acoustic source direction module stored on the computer readable medium, and configured to receive the sample elements and perform the steps of:

for the plurality of sample elements of each pair of microphones, mapping each sample element to a sub-surface of potential acoustic source locations according to its time delay and the orientation and the separation distance of the two microphones of the pair of microphones for which the sample element was calculated, and assigning to the sub-surface the numeric sample value of the sample element, producing a plurality of sub-surfaces for each pair of microphones; and calculating for a boundary surface intersecting each of the plurality of sub-surfaces and divisible into a plurality of cells, a weighted value in each cell of the boundary surface by combining the values of the plurality of sub-surfaces proximal the cell to form a weighted surface with the weighted value of each cell of the weighted surface being indicative of the likelihood that the acoustic source lies in a direction of a bearing vector passing through the cell.

* * * * *